US010321235B2

(12) United States Patent
Salvatti

(10) Patent No.: US 10,321,235 B2
(45) Date of Patent: Jun. 11, 2019

(54) TRANSDUCER HAVING A CONDUCTIVE SUSPENSION MEMBER

(71) Applicant: Apple Inc., Cupertino, CA (US)

(72) Inventor: Alexander V. Salvatti, Morgan Hill, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/275,065

(22) Filed: Sep. 23, 2016

(65) Prior Publication Data

US 2018/0091902 A1 Mar. 29, 2018

(51) Int. Cl.

| | |
|---|---|
| ***H04R 1/06*** | (2006.01) |
| ***H04R 9/04*** | (2006.01) |
| ***H04R 9/06*** | (2006.01) |
| ***H04R 7/08*** | (2006.01) |
| ***H04R 9/02*** | (2006.01) |
| *H04R 7/20* | (2006.01) |

(52) U.S. Cl.

CPC ..... *H04R 9/045* (2013.01); *H04R 1/06* (2013.01); *H04R 7/08* (2013.01); *H04R 9/02* (2013.01); *H04R 9/06* (2013.01); *H04R 7/20* (2013.01); *H04R 9/047* (2013.01); *H04R 2307/204* (2013.01); *H04R 2400/11* (2013.01); *H04R 2499/11* (2013.01)

(58) Field of Classification Search

CPC ..... H04R 1/06; H04R 9/043; H04R 29/003; H05K 1/0283

See application file for complete search history.

(56) References Cited

U.S. PATENT DOCUMENTS

| | | | | |
|---|---|---|---|---|
| 3,240,865 A * | 3/1966 | Jarnagin | ..... | H01B 1/00 174/254 |
| 6,490,363 B1 | 12/2002 | Liu | | |
| 6,853,734 B2 * | 2/2005 | Sahyoun | ..... | H04R 1/06 381/403 |
| 7,995,788 B2 | 8/2011 | Funahashi et al. | | |

(Continued)

FOREIGN PATENT DOCUMENTS

| | | |
|---|---|---|
| CN | 101654524 A | 2/2010 |
| CN | 101835074 A | 9/2010 |

(Continued)

OTHER PUBLICATIONS

Hirsch et al., "Intrinsically Stretchable Biphasic (Solid-Liquid) Thin Metal Films" Feb. 29, 2016, Advanced Materials, vol. 28, Issue 22, pp. 4507-4512.*

(Continued)

*Primary Examiner* — Curtis A Kuntz
*Assistant Examiner* — Ryan Robinson
(74) *Attorney, Agent, or Firm* — Womble Bond Dickinson (US) LLP

(57) ABSTRACT

A speaker including a frame, and a magnet assembly coupled to the frame. The magnet assembly forms an air gap through which a magnetic flux is directed. The speaker further including a voice coil suspended in the air gap, a diaphragm coupled to the voice coil and a compliant suspension member for suspending the voice coil within the air gap. The suspension member includes an electrically conductive biphasic member for providing an electrical connection between the voice coil and a circuit coupled to the frame.

25 Claims, 7 Drawing Sheets

(56) References Cited

U.S. PATENT DOCUMENTS

| | | | | |
|---|---|---|---|---|
| 8,295,538 | B2 * | 10/2012 | Harris | H04R 9/043 264/104 |
| 8,311,263 | B2 | 11/2012 | Huang | |
| 8,426,735 | B2 | 4/2013 | Troosters et al. | |
| 8,469,741 | B2 | 6/2013 | Oster et al. | |
| 9,338,532 | B2 | 5/2016 | Yan | |
| 9,503,822 | B2 * | 11/2016 | Zhao | H04R 9/06 |
| 9,621,995 | B2 * | 4/2017 | Yang | H04R 9/046 |
| 9,832,557 | B2 * | 11/2017 | Park | H04R 1/06 |
| 2001/0011615 | A1 | 8/2001 | Iwasa | |
| 2005/0147272 | A1 | 7/2005 | Hyre et al. | |
| 2007/0071274 | A1 | 3/2007 | Andersen et al. | |
| 2007/0172093 | A1 * | 7/2007 | Oyanagi | H01B 3/50 381/409 |
| 2008/0137901 | A1 | 6/2008 | Michno et al. | |
| 2009/0116682 | A1 | 5/2009 | Suzuki et al. | |
| 2009/0190792 | A1 | 7/2009 | Townsend | |
| 2009/0226028 | A1 | 9/2009 | Suganuma | |
| 2011/0274309 | A1 | 11/2011 | Doh et al. | |
| 2012/0170778 | A1 | 7/2012 | Wei | |
| 2012/0251812 | A1 | 10/2012 | Kawka et al. | |
| 2013/0016874 | A1 | 1/2013 | Huang et al. | |
| 2013/0336517 | A1 | 12/2013 | Wilk | |
| 2014/0029784 | A1 | 1/2014 | Kwon et al. | |
| 2014/0241565 | A1 | 8/2014 | Jin | |
| 2014/0270323 | A1 | 9/2014 | Permanian | |
| 2015/0256939 | A1 | 9/2015 | Zhao et al. | |
| 2015/0357078 | A1 | 12/2015 | Lessing et al. | |
| 2016/0025669 | A1 | 1/2016 | Sun et al. | |
| 2016/0302018 | A1 * | 10/2016 | Russell | H04R 9/063 |
| 2016/0366760 | A1 * | 12/2016 | Lee | H05K 1/0283 |

FOREIGN PATENT DOCUMENTS

| | | | |
|---|---|---|---|
| CN | 102067630 | A | 5/2011 |
| CN | 202050538 | U | 11/2011 |
| CN | 202587358 | | 12/2012 |
| CN | 102970642 | A | 3/2013 |
| CN | 104640051 | A | 5/2015 |
| CN | 104918195 | A | 9/2015 |
| CN | 204887423 | | 12/2015 |
| KR | 20110002370 | | 1/2011 |
| KR | 20130017552 | | 2/2013 |
| KR | 101588132 | | 1/2016 |
| WO | WO-2006043219 | | 4/2006 |
| WO | WO-2011007403 | | 1/2011 |
| WO | WO2012/093058 | A1 | 7/2012 |
| WO | WO-2013007112 | | 1/2013 |
| WO | WO-2014094776 | | 6/2014 |

OTHER PUBLICATIONS

International Search Report and Written Opinion, dated Nov. 5, 2015, Application No. PCT/US2015/043680.

Apple Inc., Notice of Allowance dated Apr. 5, 2017, U.S. Appl. No. 14/468,178.

Apple Inc., International Search Report dated Sep. 26, 2017, PCT Application No. PCT/US2017/047595.

Hirsch, et al., "Intrinsically Stretchable Biphasic (Solid-Liquid) Thin Metal Films", Advanced Materials, 28, 2016, 4507-4512.

* cited by examiner

TRANSDUCER HAVING A CONDUCTIVE SUSPENSION MEMBER

FIELD

An embodiment of the invention is directed to a transducer, for example a speaker, having a compliant suspension member that provides an electrical connection between the voice coil and transducer electrical terminals. Other embodiments are also described and claimed.

BACKGROUND

In modern consumer electronics, audio capability is playing an increasingly larger role as improvements in digital audio signal processing and audio content delivery continue to happen. In this aspect, there is a wide range of consumer electronics devices that can benefit from improved audio performance. For instance, smart phones include, for example, electro-mechanical transducers which convert an electrical audio signal into a corresponding sound. More specifically, speakerphone loudspeakers and earpiece receivers that can benefit from improved audio performance. Smart phones, however, do not have sufficient space to house much larger high fidelity sound output devices. This is also true for some portable personal computers such as laptop, notebook, and tablet computers, and, to a lesser extent, desktop personal computers with built-in speakers. Many of these devices use what are commonly referred to as "microspeakers." Microspeakers are a miniaturized version of a loudspeaker, which use a moving coil motor to drive sound output. The moving coil motor may include a diaphragm, voice coil and magnet assembly positioned within a frame. The voice coil typically includes lead wires that extend from ends of the coil and may be connected to terminals or circuitry within the speaker frame. Due to the strain on these lead wires caused by diaphragm excursion, however, the wires can break leading to reliability issues in the field.

SUMMARY

Embodiments of the invention improve transducer reliability by using a stretchable conductive material to electrically connect the moving voice coil to stationary terminals outside the transducer. In particular, instead of lead wires extending from the voice coil to the terminals, the suspension member used to suspend the diaphragm and voice coil within the frame may include a conductive component other than a wire to electrically connect the voice coil to the terminals. The conductive component may, in one embodiment, be an electrically conductive biphasic material that is formed on or within the suspension member. The biphasic material may be considered "biphasic" in that it contains a solid component and a liquid component. For example, the biphasic material may include a solid layer or film of a conductive alloy such as gold-gallium and a liquid layer of a conductive material such as gallium formed on the solid layer. The gallium may be in a liquid form and formed as discrete bulges, deposits or protrusions along the solid layer.

Incorporating such a biphasic material into a transducer suspension member to provide an electrical connection to the voice coil has several advantages. For example, the biphasic material has been shown to have good reliability in high cycle fatigue and therefore provides better mechanical robustness than a wire. In particular, due to the solid-liquid nature of the biphasic material, it can accommodate high strain caused by movement (e.g., stretching) of the suspension member without fracture. Moreover, the liquid component supplies negligible stiffness. Thus, the integration of the biphasic material into the suspension member does not significantly impact the overall stiffness of the suspension member, which must be symmetrical in order to avoid exciting rocking modes or introducing undesirable distortion which is deleterious to performance. Still further, the electrical properties of the biphasic material can be used to protect the diaphragm and monitor diaphragm displacement. In particular, the electrical resistance of the biphasic material varies proportionally with the strain. Thus, as the driver, and associated diaphragm, excursion is reaching its maximum limit, the strain in the electrical path between the voice coil and the terminals will gradually rise. If the transducer is driven from a voltage source as is commonly done, this would reduce the amount of current being delivered through the biphasic material to the voice coil and prevent excursion beyond a maximum desired limit. If driven from a current source, the strain experienced by the biphasic material would lead to corresponding variations in the voltage drive level, an effect which could similarly be used either to sense or control excursion. The biphasic material is therefore considered to provide a self-limiting mechanism that may be used to prevent excessive diaphragm excursion. In addition, the gauge factor (e.g., relative change in electrical resistance to the mechanical strain) of the biphasic material is one (1). Thus, the linear behavior of the electrical resistance versus strain behavior of the biphasic material can be detected by circuitry associated with the device and used as a strain gauge, e.g., a sensor to determine the instantaneous diaphragm position. It should further be understood that biphasic materials as previously discussed, may be used with any transducer which requires physical electrical connections to a moving coil, including dynamic microphones, actuators, and loudspeakers, though for simplicity, reference will usually be made to the loudspeaker application herein.

Representatively, one embodiment of the invention is directed to a speaker including a frame having a terminal coupled thereto. A magnet assembly may be coupled to the frame and the magnet assembly may form an air gap through which a magnetic flux is directed. The speaker further includes a voice coil suspended in the air gap, a diaphragm coupled to the voice coil, a compliant suspension member for suspending the voice coil within the air gap. The suspension member may include an electrically conductive biphasic member for providing an electrical connection between the voice coil and the terminal. In one embodiment, the electrically conductive biphasic member includes a solid component formed on the suspension member and a liquid component formed on the solid component. The solid component may include a gold-gallium alloy and the liquid component may include liquid gallium deposits. In some embodiments, the electrically conductive biphasic member includes a film of biphasic material, and the film of biphasic material is formed on a surface of the suspension member. In still further embodiments, the electrically conductive biphasic member includes a layer of gold-gallium alloy formed on the suspension member and a plurality of liquid gallium protrusions formed on the layer of gold-gallium alloy. In some cases, the speaker further includes a circuit electrically connected to the terminal, and the circuit may be a diaphragm displacement sensing circuit operable to detect a displacement of the diaphragm by detecting an electrical resistance resulting from a strain on the electrically conductive biphasic member as the diaphragm is displaced.

Another embodiment of the invention is directed to a transducer (e.g., a speaker or actuator) including a stationary portion having a terminal coupled thereto. The transducer further includes a moving portion that is operable to move in response to a Lorentz force and generate a physical vibration or sound. In addition, the transducer includes a compliant suspension member for suspending the moving portion from the stationary portion and a biphasic electrode layer coupled to the compliant suspension member. The biphasic electrode layer is operable to provide an electrical connection between the moving portion and the terminal coupled to the stationary portion. The biphasic electrode layer may include a first section extending along a first side of the voice coil and a second section extending along a second side of the voice coil, and the first section is electrically isolated from the second section. In some cases, the first section is electrically connected to an outer wire layer of the voice coil and the second section is electrically connected to an inner wire layer of the voice coil. In some embodiments, the stationary portion is a frame and the moving portion is a voice coil connected to a diaphragm, and which are suspended within the frame by the suspension member. The biphasic electrode layer may include a solid layer of a conductive alloy deposited on a surface of the suspension member and a liquid layer comprising conductive projections formed on the solid layer. In some embodiments, the transducer further includes circuit electrically connected to the terminal. The circuit may be operable to detect a strain on the biphasic electrode layer and determine a displacement of the diaphragm. In still further embodiments, the biphasic electrode layer is operable to modify an excursion of the diaphragm depending upon a strain on the biphasic electrode layer.

Another embodiment of the invention is directed to a speaker suspension member having a compliant membrane and a biphasic electrode. The suspension member is dimensioned to suspend a speaker diaphragm and voice coil from a speaker frame. The biphasic electrode includes a solid layer connected to the compliant membrane and a liquid layer connected to the solid layer. In one embodiment, the solid layer includes a gold-gallium alloy film formed directly on the compliant membrane. The liquid layer may include a plurality of discrete liquid gallium deposits formed directly on the solid layer. The biphasic electrode may include at least one conductive trace line patterned to electrically connect the voice coil to a circuit. In some embodiments, the biphasic electrode is a first biphasic electrode, and the speaker suspension member further comprises a second biphasic electrode coupled to the compliant membrane, and the first biphasic electrode is spaced a distance from the second biphasic electrode.

A further embodiment of the invention is directed to a planar magnetic transducer, which uses a series of conductive traces embedded or otherwise attached to the diaphragm. This method of constructing an electromechanical transducer has some advantages for form factor and performance, for example, allowing very thin and flat aspect ratio transducers which may be more suited to particular applications. Besides the form factor, the planar transducer has additional advantages in that a larger portion of the moving surface of the diaphragm can be more evenly driven, as opposed to the typical voice-coil based transducers which are driven only at the location where the voice coil is attached to the diaphragm, usually near the outer perimeter.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1:
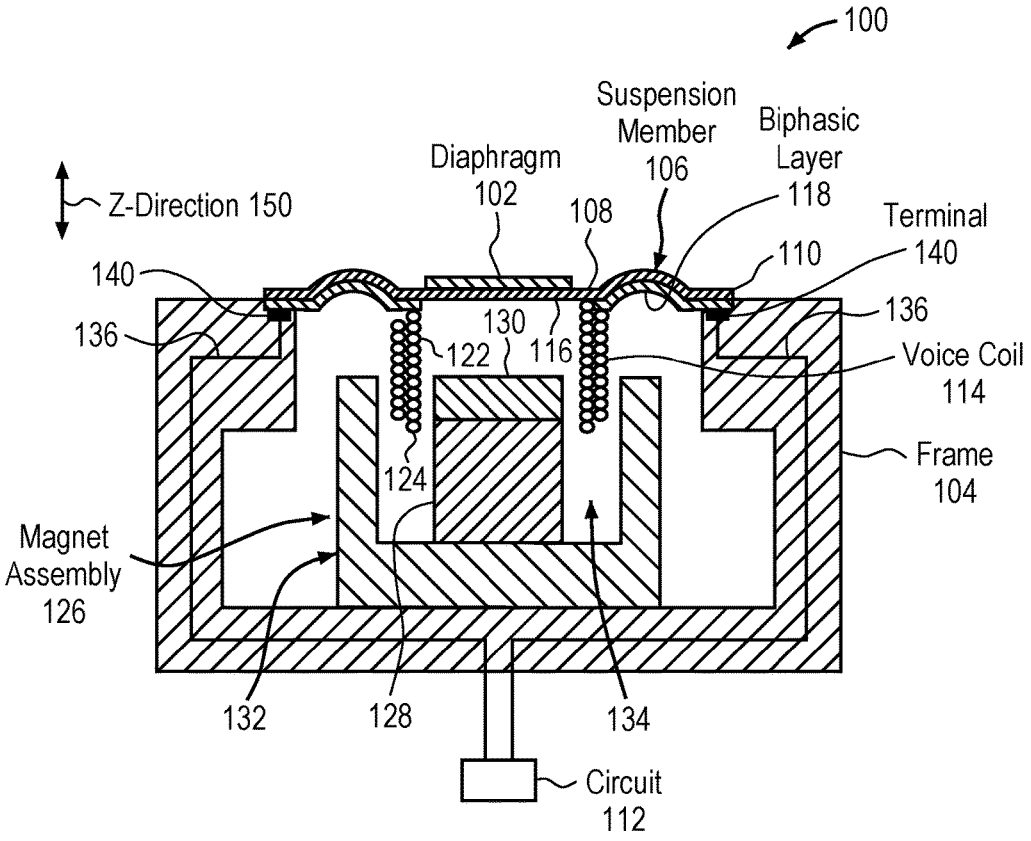
FIG. 1 illustrates a cross-sectional side view of one embodiment of a transducer.

FIG. 1 illustrates a cross-sectional side view of one embodiment of a transducer. Transducer 100 may be, for example, an electro-acoustic transducer that converts electrical signals into audible signals that can be output from a device within which transducer 100 is integrated. For example, transducer 100 may be a speaker or microspeaker such as a speakerphone speaker or an earpiece receiver found within a smart phone, or other similar compact electronic device such as a portable timepiece, laptop, notebook, or tablet computer. Alternatively, transducer 100 may be integrated into a non-portable device, and/or may be any other type of device that converts one form of energy to another, for example, a vibration motor or any other types of transducers discussed herein. Transducer 100 may be enclosed within a housing or enclosure of the device within which it is integrated.

Transducer 100 may include a moving portion and a stationary portion. For example, the moving portion may be a sound radiating surface (SRS) or diaphragm 102 that moves with respect to a stationary frame 104. Diaphragm 102 may be any type of diaphragm or sound radiating surface capable of vibrating in response to an acoustic signal to produce acoustic or sound waves. In this aspect, diaphragm 102 may have any size and shape suitable for radiating sound, for example, circular, square, or rectangular.

Diaphragm 102 (e.g., a moving portion) may be suspended within frame 104 (e.g., a stationary portion) of transducer 100 by suspension member 106. Representatively, in one embodiment, suspension member 106 may include a sheet of compliant material (e.g., a membrane) which is positioned across an opening in frame 104 and diaphragm 102 is a layer of stiffening material attached to a top side or surface 108 of suspension member 106. For example, suspension member 106 may be a thermoformed silicone membrane having an outer edge 110 that is attached (e.g., molded, adhered or chemically bonded), or otherwise sealed, to the frame 104. The suspension member 106 may be of a suitable size, thickness, compliance, etc., to allow for vibration of the diaphragm 102 attached thereto. For example, suspension member 106 may have a "rolled" configuration in that it has a bowed or curved region to allow for greater compliance and/or excursion in a z-direction (e.g., direction parallel to an axis of the suspension member 106). It should further be understood that materials other than silicone may be used to form the suspension member 106, for example, a thermoformable plastic material such as polyurethane (PU), thermoplastic polyurethane (TPU), polyether ether ketone (PEEK) or the like. The diaphragm 102 may be formed by a polymeric layer attached (e.g., molded, adhered or chemically bonded) to a center portion of surface 108 of the suspension member 106. For example, the diaphragm 102 may be made of a polymer membrane formed using polyethylene naphthalate (PEN), polyimide (PI) or polyethylene terephthalate (PET). In addition, it should further be understood that while in FIG. 1, diaphragm 102 is shown as including a layer of stiffening material formed on a portion of suspension member 106, in other embodiments, diaphragm 102 may be a single layer of stiffening material that is positioned over an opening in suspension member 106 and attached along its edges to suspension member 106.

Transducer 100 may also include a voice coil 114 positioned along a bottom side or surface 116 of suspension member 106 (i.e., a face of suspension member 106 facing magnet assembly 126) such that it is below diaphragm 102. For example, in one embodiment, voice coil 114 includes an upper end 122 and a lower end 124. The upper end 122 may be directly attached to surface 116 of suspension member 106, such as by chemical bonding or the like. In another embodiment, voice coil 114 may be wrapped around a former or bobbin and the former or bobbin is directly attached to the surface 116 of suspension member 106. In one embodiment, voice coil 114 may have a similar profile and shape to that of diaphragm 102. For example, in a plan view, diaphragm 102 may have a square, rectangular, racetrack, or circular profile, voice coil 114 may have a corresponding square, rectangular, racetrack, or circular profile. Voice coil 114 may include conductive wires or windings that form conductive paths, e.g., wires, traces, etc., that convey electrical current. The conductive paths may permit current to flow in a given direction relative to a corresponding magnetic field such that a Lorentz force is generated to move voice coil 114 and any member to which it is attached, e.g., diaphragm 102, with respect to a stationary component (e.g. frame 104).

Returning again to suspension member 106, suspension member 106 may further include an electrically conductive biphasic material layer 118 (also referred to herein as a "biphasic material layer", "biphasic member" or "biphasic electrode") that electrically connects voice coil 114 to terminals 140 associated with frame 104 of transducer 100. Terminals 140 may, for example, be contact points which are electrically connected to the ends of wires 136, or may be the ends of wires 136 themselves, and which provide a point of electrical connection to circuit 112. It should further be understood that while terminals 140 are shown formed where biphasic material layer 118 interfaces with frame 104, they may be formed at other positions along frame 104 (e.g., at any position where another component interfaces with frame 104). In addition, in some embodiments, only terminals 140 may be present on frame 104, and wires 136 and/or circuit 112 omitted or assembled separately from transducer 100. For example, in one embodiment, wires 136 may be omitted and the biphasic material layer 118 itself may extend along frame 104 to a terminal near circuit 112.

Returning now to FIG. 1, electrically conductive biphasic material layer 118 may run along suspension member 106 (e.g., attached to a bottom side 116), and extend from voice coil 114 to terminals 140 positioned on or within frame 104. Alternatively, biphasic material layer 118 may be formed within, or otherwise embedded within, suspension member 106. In either case, the biphasic material layer 118 may be formed in any manner with suspension member 106, and in any shape, configuration or pattern, suitable for electrically connecting terminals at, for example, the top end 122 of voice coil 114 to terminals 140 on frame 104 as shown. The biphasic material layer 118 may be considered "biphasic" in that it includes both a solid component and a liquid component. The solid component may, in one embodiment, be a solid layer of conductive material formed on, or embedded within suspension member 106, and the liquid component may be a layer of liquid material formed on the solid layer. The solid layer of conductive material may, in one embodiment, be a film made of a gold-gallium alloy and the liquid material may be discrete bulges, deposits or protrusions containing liquid gallium formed along a surface of the gold-gallium alloy film. It should further be understood that while a gold-gallium alloy and liquid gallium are provided as examples of the solid-liquid materials making up the biphasic material layer 118, other conductive materials having similar properties to those specifically listed may be used.

As can be understood from FIG. 1, an excursion or vibration of diaphragm 102 in the z-direction (as illustrated by arrow 150) causes the suspension member 106 to vibrate or stretch to accommodate the movement of diaphragm 102. This movement causes a significant amount of strain within the region of the suspension member 106 between the moving voice coil 114 and the stationary frame 104. Therefore, when voice coil lead wires are used within this region to make electrical connections, a significant amount of strain is placed on the wires, and may lead to fracture and mechanical failure. Due to the biphasic nature of the biphasic material layer 118, however, the layer has better reliability in high cycle fatigue than wire and can withstand the high strain within this region without fracture. Therefore, replacing voice coil lead wires within this region with a conductive biphasic material layer 118 improves transducer reliability within the field.

In addition, as previously discussed, the electrical properties of the biphasic material can be used to protect diaphragm 102 from excessive excursion and monitor diaphragm displacement. In particular, since the electrical resistance of the biphasic material layer 118 varies proportionally with the strain, as the excursion of diaphragm 102 is reaching its maximum limit, the strain in the biphasic material layer 118 and associated electrical path through biphasic material layer 118 will gradually rise. This, in turn, will reduce the amount of current being delivered through biphasic material layer 118 to voice coil 114 and in turn the excursion of diaphragm 102. The biphasic material layer 118 therefore provides a self-limiting mechanism that prevents or modifies diaphragm excursion depending upon a strain on the biphasic material layer 118. Moreover, because the gauge factor (e.g., relative change in electrical resistance to the mechanical strain) of the biphasic material layer 118 is approximately one, linear behavior of the electrical resistance versus strain behavior of the biphasic material layer 118 can be detected by circuit 112 and serve as a strain gauge or a sensor for monitoring diaphragm position. For example, circuit 112 may be used to detect a displacement or position of the diaphragm by detecting an electrical resistance resulting from a strain on the electrically conductive biphasic material layer 118 as the diaphragm 102 is displaced. In this aspect, circuit 112 may include a displacement sensing circuit having circuitry and/or electrical components to facilitate diaphragm displacement monitoring. In addition, circuit 112 may include speaker circuitry for driving speaker operations, for example, providing an electrical current to voice coil 114. Additional details of the biphasic material layer 118 will be discussed in reference to FIG. 2 to FIG. 9.

Transducer 100 may further include a magnet assembly 126 positioned below the diaphragm 102, suspension member 106 and voice coil 114. Magnet assembly 126 may include a magnet 128 (e.g., a NdFeB magnet), with a top plate 130 and a yoke 132 for guiding a magnetic circuit generated by magnet 128. Magnet assembly 126, including magnet 128, top plate 130 and yoke 132 may be positioned below diaphragm 102, in other words, magnet assembly 126 is positioned between diaphragm 102 and frame 104. In one embodiment, magnet 128 may be a center magnet positioned entirely within an open center of voice coil 114. In this aspect, magnet 128 may have a similar profile as voice coil 114 and voice coil 114 may be suspended within a magnetic gap or air gap 134 formed between magnet 128 and yoke 132 to drive movement of voice coil 114, and through which a magnetic flux is directed. It should be understood, however, that FIG. 1 shows one non-limiting example of a transducer, and that there are many other configurations of transducer drive mechanisms which would equally benefit from the invention, for example electrostatic planar magnetic, or the like. In other words, any transducer which makes electrical contact to a moving coil, or makes contact to an electrical component on the moving portion of the assembly, could benefit from a biphasic material layer or electrode as disclosed herein.

Figure 2:
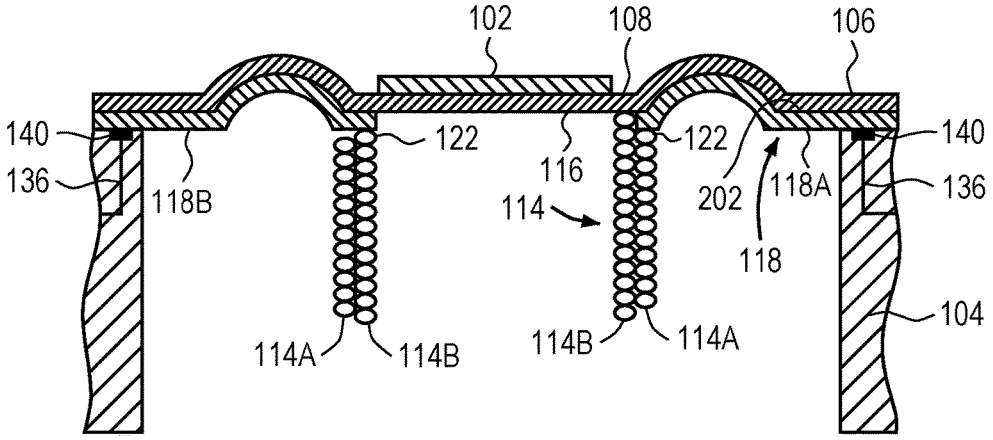
FIG. 2 illustrates a cross-sectional side view of one embodiment of a suspension member and electrically conductive biphasic material layer of the transducer of FIG. 1.

The specific details of the suspension member 106 and biphasic material layer 118 arrangement will now be described in more detail in reference to FIG. 2 to FIG. 8. Representatively, FIG. 2 illustrates a cross-sectional side view of one embodiment of the suspension member 106 and conductive biphasic material layer 118 shown in FIG. 1. From this view, it can be seen that, in one embodiment, the electrically conductive biphasic material layer 118 includes a top face 202 that can be attached to, and extend along, a bottom side 116 of suspension member 106 (e.g., a side facing voice coil 114). The biphasic material layer 118 is then electrically connected at one side or end (e.g., by soldering) to a terminal of the voice coil 114 (e.g., a terminal at top end 122) and at another side or end to terminals 140, which could be electrically connected to wires 136 associated with circuit 112 (see FIG. 1). In this aspect, an electrical current can travel, via the biphasic material layer 118, between the voice coil 114 and circuit 112 without the need for a voice coil lead wire.

Referring in more detail to voice coil 114, voice coil 114 may be a double wound coil having an outer coil layer 114A terminating at a positive voice coil terminal and an inner coil layer 114B terminating at a negative voice coil terminal. In this aspect, biphasic material layer 118 may include a conductive break so as not to short circuit an electrical current through voice coil 114. The conductive break may be, for example, an area of non-conductivity between, for example, a left and right side, or a top and bottom, of the biphasic material layer 118. For example, as shown in FIG. 2, biphasic material layer 118 may include a first section 118A that is electrically isolated from a second section 118B. For example, the first section 118A and the second section 118B may be two discrete and separate pieces of the biphasic material layer 118 that are spaced a distance apart to achieve the conductive break. The first section 118A may be electrically connected (e.g., soldered) to the terminal (e.g., a positive voice coil terminal) associated with the outer coil layer 114A and the nearby wire 136 to circuit 112. The second section 118B may be electrically connected (e.g., soldered) to the terminal (e.g., a negative voice coil terminal) associated with the inner coil layer 114B and the nearby wire 136 to circuit 112. As previously discussed, the circuit 112 may include speaker circuitry for driver speaker operations, and/or diaphragm displacement sensing circuitry for monitoring a displacement, excursion or position of the diaphragm 102.

Figure 3:
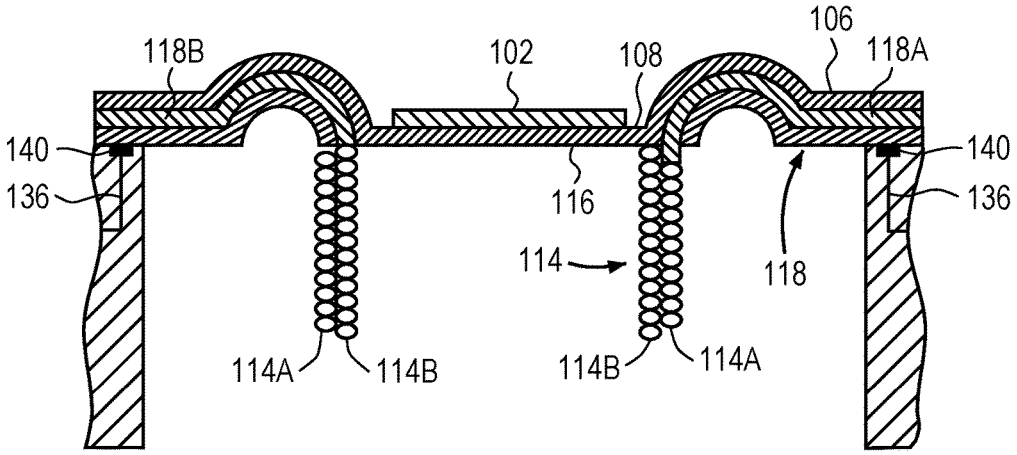
FIG. 3 illustrates a cross-sectional side view of one embodiment of a suspension member and electrically conductive biphasic material layer of the transducer of FIG. 1.

FIG. 3 illustrates a cross-sectional side view of another embodiment of the suspension member 106 and conductive biphasic material layer 118 shown in FIG. 1. The transducer components of FIG. 3 are substantially the same as those previously discussed with respect to FIG. 1 and FIG. 2, except in this embodiment, the biphasic material layer 118 is embedded, or otherwise formed within, suspension member 106. For example, except for the ends of biphasic material layer 118 (which are electrically connected to voice coil 114), the biphasic material layer 118 is completely, or at least partially, encased or embedded within the material of suspension member 106 as shown. Said another way, both the top and bottom surfaces of biphasic material layer 118 are in contact with, and covered by, the suspension member 106. For example, this configuration may be accomplished by forming (e.g., thermoforming, compression molding, injection molding, etc.) a layer of the material used to form the suspension member 106 (e.g., silicone), forming the biphasic material layer 118 on the layer of suspension member material and then forming another layer of the suspension member material on the biphasic material layer 118 to complete the stack up. As can be seen from FIG. 3, the ends of the biphasic material layer 118 are exposed through the suspension member 106 so that they can be electrically connected to the voice coil 114 and respective wires 136. In addition, as previously discussed, the biphasic material layer 118 may include a first section 118A electrically connecting the outer voice coil layer 114A to wire 136 of circuit 112, and a second section 118B electrically connecting the inner voice coil layer 114B to wire 136 of circuit 112.

Figure 4:
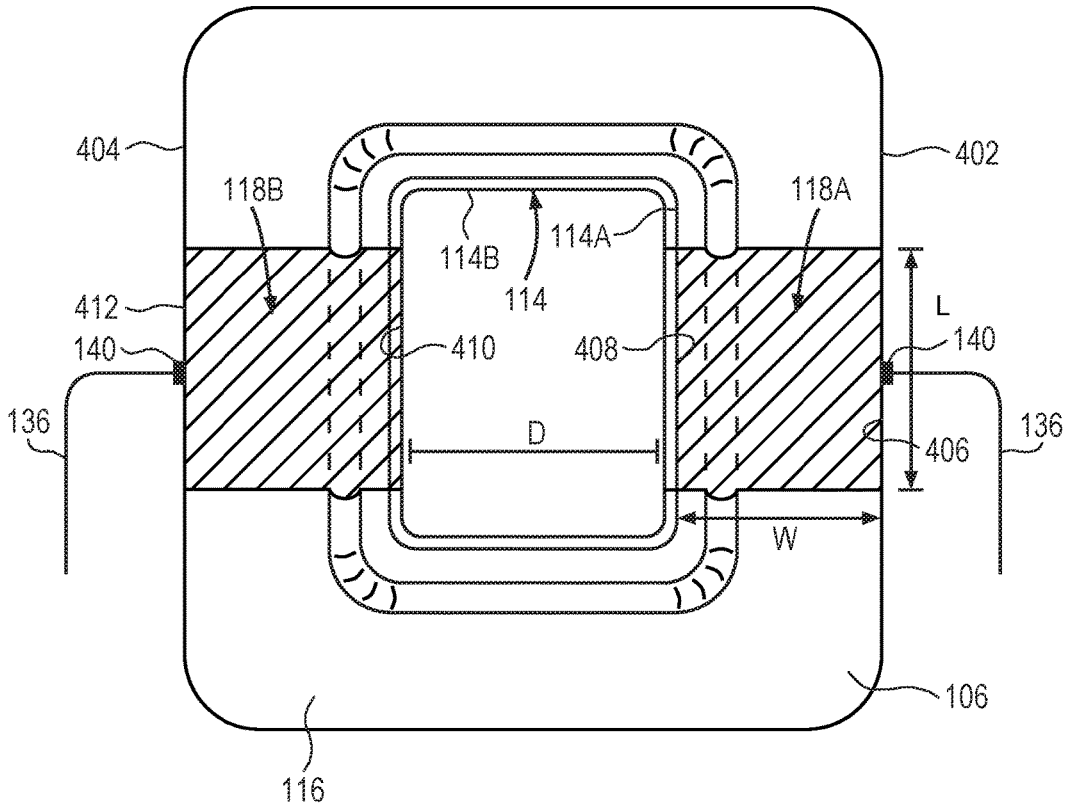
FIG. 4 illustrates a bottom plan view of one embodiment of the suspension member and electrically conductive biphasic material layer of FIG. 1.

FIG. 4 illustrates a bottom plan view of one embodiment of the suspension member and electrically conductive biphasic material layer of FIG. 1 to FIG. 3. In particular, from this view, it can be seen that suspension member 106 is a substantially solid sheet of material (e.g., silicone) having a rectangular shaped profile (although other profiles are contemplated). In this aspect, suspension member 106 may have four sides and the corresponding edges 402 and 404 may be electrically attached to terminals 140 and wires 136 on portions of a surrounding frame (e.g., frame 104 of FIG. 1). Voice coil 114, having outer and inner voice coil layers 114A and 114B, respectively, may be attached to the bottom side 116 of suspension member 106. Although not shown, the diaphragm may be attached to the top side of suspension member 106, and over the voice coil 114.

In this embodiment, a first section 118A and a second section 118B of the biphasic material layer 118 are formed as sheet like structures and are positioned on the bottom 116 of suspension member 106. For example, first section 118A has a substantially rectangular or square shape having a length (L) dimension and a width (W) dimension. In one embodiment, the length (L) dimension is longer than the width (W) dimension such that first section 118A covers a substantial area of suspension member 106. The width (W) dimension may be substantially the same as a distance between voice coil 114 and edge 402 of suspension member 106 so that first section 118A extends between the two. Representatively, edge 408 of first section 118A may be in contact with, and electrically connected to, outer voice coil layer 114A and the opposing edge 406 may be in contact with, and electrically connected to, stationary terminal 140 and wire 136 positioned near edge 402 of suspension member 106. Second section 118B may have similar dimensions to that of first section 118A, but be spaced a distance (D) from first section 118A to provide a conductive break. For example, second section 118B may have an edge 412 that is in contact with, and electrically connected to, terminal 140 and wire 136 positioned near edge 404 of suspension member 106, and an opposing edge 410 that is in contact with, and electrically connected to, inner voice coil layer 114B. It should be noted that in embodiments where first and second sections 118A, 118B are sheets of material, it is desirable for each of sections 118A, 118B to cover a large surface area of suspension member 106 in order to reduce the electrical resistance and lower the stresses within the biphasic material. Thus, it is contemplated that although rectangular sections 118A and 118B are shown, they may have other shapes and sizes which increase their surface area, for example, they may be "C" or "U" shaped sections which surround voice coil 114 and cover a substantial surface area of suspension member 106. It should be noted, however, that to maintain a conductive break, at least some sort of gap or spacing should be formed between the conductive biphasic material of the biphasic material layer sections 118A, 118B. Thus, in most cases, the combination of sections 118A, 118B will cover less than an entire perimeter of suspension member 106. The substantial surface area of the suspension member 106 also serves to counteract any limitations on the practical thickness of the biphasic material layer 118, which may be limited to rather thin cross sections depending on the method of deposition or application.

Figure 5:
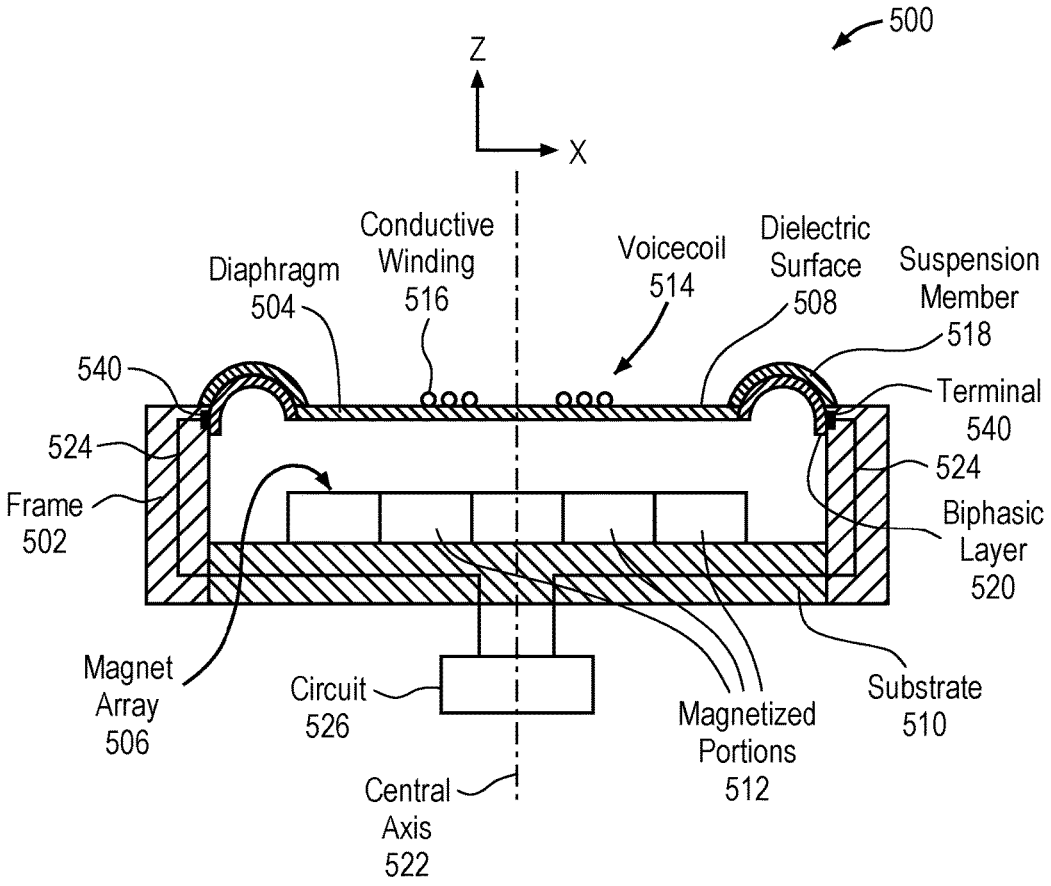
FIG. 5 illustrates a cross-sectional side view of another embodiment of a transducer.

FIG. 5 illustrates a cross-sectional side view of another embodiment of a transducer. In this embodiment, transducer 500 is shown as a planar magnetic transducer. More specifically, transducer 500 is a microspeaker having a single voice coil module including a conductive winding paired with a magnetic array (although multiple modules may be used). Transducer 500 may include a frame 502 to surround or support a diaphragm 504 relative to one or more magnetic arrays 506. Frame 502 may, for example, be a portion of a micro speaker housing. Diaphragm 504 may have any outer shape, and thus, although a rectangular diaphragm is shown, diaphragm may be circular, polygonal, etc. Diaphragm 504 may be constructed from known materials used in the construction of speaker diaphragms, including paper, thermoformed polymers such as PEEK, PEN, PAR, woven fiberglass, aluminum, or composites made of such materials. Thus, in some instances, diaphragm 504 may include a dielectric surface 508, e.g., a front or a back surface, extending between the diaphragm edges supported by frame 502. Dielectric surface 508 may be flat, as in the case of a planar diaphragm, or may be conical or curved, as in the case of a cone or dome diaphragm, or some combination of planar portion and curved portion as dictated by the design requirements. Diaphragm 504 may be constructed entirely from a dielectric material, or a portion of the front or back surface of diaphragm may be coated with a dielectric material to form dielectric surface, as in the case of an aluminum diaphragm coated with a parylene film.

A voice coil 514 may be integrated with diaphragm 504. More particularly, voice coil 514 may be formed from electrical wiring disposed on, and running over or along, dielectric surface of diaphragm 504. The electrical wiring may form one or more conductive windings 516 on diaphragm 504. More generally, conductive windings 516 may be conductive paths, e.g., wires, traces, etc., that convey electrical current. Thus, while the conductive paths are referred to throughout the following description as conductive windings, wire segments, etc., it shall be understood that conductive windings 516 may be any conductive material formed using known techniques to permit current to flow in a given direction relative to a corresponding magnetic field such that a Lorentz force is generated to move the conductive windings 516 and any substrate to which the windings are attached, e.g., a diaphragm. A conductive winding 516 may have one or more turns within an outer perimeter of diaphragm 504, i.e., the conductive winding 516 may run continuously along and entirely over a surface of diaphragm 504. As such, each turn may be separated from the perimeter of diaphragm 504 by a distance such that the turns are suspended inward from frame 502 on a moveable portion (along a central axis) of diaphragm 504. The turns may include a winding segment parallel to a longitudinal axis of corresponding magnetized portions 512, e.g. a winding length, and a winding segment transverse to the longitudinal axis, e.g., a winding width.

Each conductive winding may be a portion of voice coil 514 that includes one or more loops running along dielectric surface 508. Each loop may have an outer profile or perimeter that is within an outer perimeter of diaphragm 504, i.e., each loop may run continuously along and entirely over a surface of diaphragm 504. Furthermore, the respective loops of each conductive winding may be coplanar. For example, a conductive winding may have several loops that are continuously formed in a spiral from an outer loop with a larger diameter to an inner loop with a smaller diameter. All of the loops may be within a coil plane. Furthermore, the coil plane may be parallel to the surface of diaphragm, and thus, the loops may run around and surround an axis that runs orthogonal to the coil plane. The conductive windings may be formed on diaphragm 504 by printing or etching the windings on dielectric surface using known manufacturing techniques.

Each coil may be formed with alternative topologies that do not include loops. For example each coil may include wire segments that are adjacent but do not directly form a loop as long as the current in each segment runs in the proper direction for sufficiently useful Lorentz force. The wire segments or turns may be generally centered over a portion of the magnet array where the magnetic field lines are coplanar with the plane of the windings, wire segments, turns, etc.

In an embodiment, the conductive windings of voice coil 514 may be in series with one another. For example, a first conductive winding may be electrically connected to a positive lead, and a second conductive winding may be electrically connected to a negative lead, and the positive lead and the negative lead may be electrically connected through the first and second conductive windings. Alternatively, the conductive windings may be electrically connected in parallel. An alternate embodiment consists of effectively forming multiple voicecoils on diaphragm 504 since each set of conductive windings may be separately actuated, i.e., be subjected to different electrical currents through different electrical circuits. The electrical leads may extend from the conductive windings 516 suspended inward from frame 502 to the outer perimeter of diaphragm 504, and thus, may traverse the distance between the turns of conductive windings 516 and the outer perimeter or edge of diaphragm 504. A combination of these connections (series-parallel) may also be used.

Frame 502 may support diaphragm 504 relative to magnetic arrays 506 using suspension member 518. Suspension member 518 may be substantially similar to suspension member 518 described in reference to FIG. 1 to FIG. 3, and include a biphasic layer 520 to provide an electrical connection between voice coil 514 and circuit 526. Representatively, the electrically conductive biphasic material layer 520 may run along suspension member 518 (e.g., attached to the bottom side of the suspension member), and extend from voice coil 514 to terminals 540 associated with wires 524 of circuit 526. Alternatively, biphasic material layer 520 may be formed within, or otherwise embedded within, suspension member 518. In either case, the biphasic material layer 520 may be formed in any manner with suspension member 518, and in any shape, configuration or pattern, suitable for electrically connecting voice coil 514 to terminals 540, and wires 524 running through frame 502, and performing the operations previously discussed in reference to FIG. 1 to FIG. 4.

Frame 502 may also hold substrate 510 around an edge of the substrate 510, and each magnetic array may be located on a face of substrate 510 such that a top face of the magnetic arrays is facing toward a respective conductive winding of voice coil 514. Substrate 510 may be a material that is rigid enough to support the magnetic arrays. For example, substrate may be a metal or polymer, e.g., acrylonitrile butadiene styrene (ABS) or aluminum. Beneficially, since the magnetic array 506 (also referred to as Halbach magnetic arrays) inherently generates a magnetic field that is strongest on the top face opposite from the bottom face adjacent to substrate 510, substrate 510 may be formed from either nonmagnetic or ferromagnetic material without disrupting the magnetic field applied to the voicecoil during speaker driving.

Each magnetic array 506 on substrate 510 may include several magnetized portions 512. The magnetized portions may be magnetized by individually exposing different regions of a sheet of magnetic material, e.g., powdered ferrite in a binder, to different magnetic field. Alternatively, the magnetized portions may be separate magnets, e.g., magnetic bars, which are magnetized in different directions and then arranged side-by-side to effectively form a flat magnetic array with a rotating magnetic field. The effect of such rotating magnetic field is described in greater detail below.

Furthermore, diaphragm 504 and magnetic array 506 may be arranged relative to a central axis 522 such that dielectric surface 508 and a top face of magnetic array 506 are orthogonal to central axis. More particularly, conductive winding 516 of a voice coil module may be wound around central axis 522 such that the loops form a planar winding, e.g., spiraling from an outer dimension to an inner dimension. The planar winding may be parallel to the arrangement of magnetic portions 512, which may similarly be arranged in a side-by-side fashion linearly along substrate such that a longitudinal axis of each magnetized portion (as well as a transverse axis running orthogonal to the longitudinal axes through all of the magnetized portions) are orthogonal to central axis. As such, a magnetic field generated by the magnetic array, when it is directed upward along central axis, shall be directed toward conductive winding of voicecoil. Thus, when transducer 500 is located within a device such that central axis runs through magnetic array and diaphragm toward a wall of the device, when voicecoil is actuated by applying an electrical current through conductive windings, voicecoil drives diaphragm to generate sound that is emitted forward along central axis through a port in the housing wall and into a surrounding environment.

Figure 6:
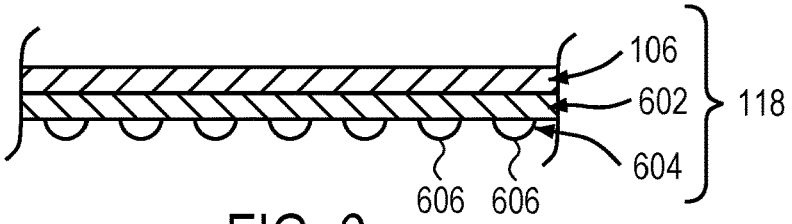
FIG. 6 illustrates a magnified cross-sectional view of one embodiment of suspension member and electrically conductive biphasic material layer stack up.
Figure 7:
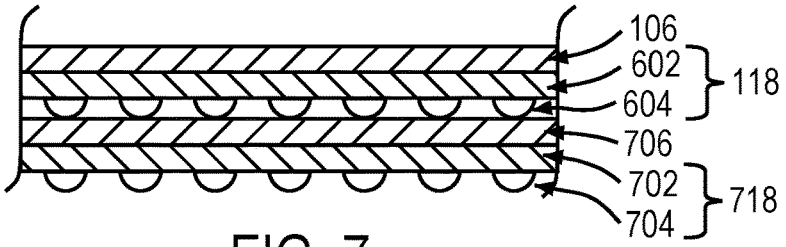
FIG. 7 illustrates a magnified cross-sectional view of another embodiment of suspension member and electrically conductive biphasic material layer stack up.
Figure 8:
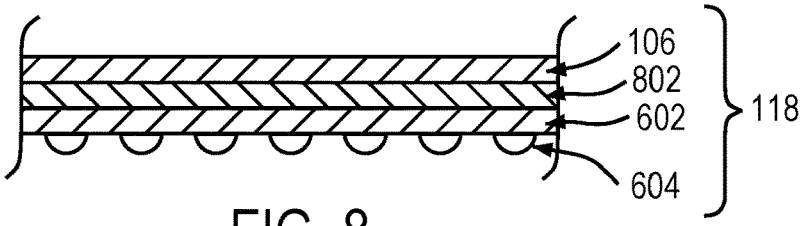
FIG. 8 illustrates a magnified cross-sectional view of another embodiment of suspension member and electrically conductive biphasic material layer stack up.

Referring now to FIG. 6 to FIG. 8, these figures show magnified cross-sectional views of embodiments of the suspension member and biphasic material layer stack up. Representatively, FIG. 6 shows suspension member 106 with the biphasic material layer 118 attached to a surface of suspension member 106. The suspension member 106 may be a silicone membrane, or a membrane formed from any other type of stretchable and/or compliant material, for example, a membrane made of PU, TPU, PEEK or the like. It should be understood that while suspension member 106 is described herein as a suspending member for a diaphragm and voice coil, it could be any type of stretchable or compliant membrane or substrate upon which a biphasic material layer 118 can be formed, deposited, or embedded. The biphasic material layer 118 includes a solid layer 602 and a liquid layer 604 as previously discussed. The solid layer 602 is attached to the suspension member 106 and the liquid layer 604 is formed on the solid layer 602. In this embodiment, the liquid layer 604 is shown formed on a side of the solid layer 602 opposite the suspension member 106. The liquid layer 604, however, could also be formed on the side of solid layer 602 facing suspension member 106. The liquid layer 604 may include discrete (e.g., separate) deposits, bulges or protrusions 606 along a surface of the solid layer 602.

In one embodiment, the solid layer 602 may be a thin film layer of a gold-gallium alloy and the liquid layer 604 may be protrusions 606 including liquid gallium formed on the gold-gallium alloy film layer. The combination of the liquid gallium within protrusions 606 and the gold-gallium solid layer 602 allow for electrical continuity throughout the biphasic material layer 118, especially as the material is strained which tends to crack the solid portion, but the liquid phase effectively fills in the micro-cracks, healing the material and maintaining approximately uniform conductivity. One representative method for manufacturing the suspension member 106 and biphasic material layer 118 shown in FIG. 6 will now be described. Representatively, in one embodiment, a silicone sheet may be thermoformed into a size and shape desired for the suspension member 106 (e.g., size and shape suitable for suspending a diaphragm and voice coil). Next, a thin film of gold is deposited (e.g., sputtering) on a surface of the suspension member 106 in the desired region. Liquid gallium is then deposited on the gold film and subjected to thermal evaporation. This causes the gold film to alloy with the evaporated gallium and form a solid gold-gallium alloy film layer as well as an accumulation of liquid gallium microscopic protrusions (e.g., a liquid layer). The liquid gallium permeates though the protrusions to provide electrical continuity throughout the material. In some embodiments, additional liquid gallium is deposited to further increase the size of the protrusions. It should further be noted that although suspension member 106 is described as being thermoformed into the desired shape prior to adding the biphasic material layer 118, in some embodiments, the suspension member 106 may be formed from a silicone sheet with the biphasic material layer already formed thereon. Alternatively, suspension member 106 may be designed to be used in a flat state, such that no forming is necessary, using the compliance of the substrate itself rather than adding out-of-plane geometry.

FIG. 7 shows a cross-sectional side view of another embodiment of a suspension member and biphasic material layer stack up. In this embodiment, the suspension member 106 and biphasic material layer 118 having solid layer 602 and liquid layer 604 can be formed as discussed in reference to FIG. 6. This stack up, however, also includes a second layer of silicone material forming a suspension member 706 as well as a second biphasic material layer 718 (made up of solid layer 702 and liquid layer 704 as previously discussed). In particular, suspension member 706 is formed on the previously formed liquid layer 604 of the first biphasic material layer 118. It is noted that the biphasic material layer 118 can be considered embedded within, or otherwise formed within, the suspension member 106 because it is covered on both sides by a suspension member material. The second biphasic material layer 718 can further be formed over the second suspension member 706. Since each of the different biphasic material layers 118 and 718 are electrically isolated from one another by a layer of suspension member 706, they can have different electrical patterns and/or connect to different circuitry within the transducer (e.g., one to a speaker circuit for driving speaker operations and one to a diaphragm displacement circuit for monitoring diaphragm displacement as previously discussed). It should further be understood that in some embodiments, only the second suspension member 706 may be included and the second biphasic material layer 718 omitted.

FIG. 8 shows a cross-sectional side view of another embodiment of a suspension member and biphasic material layer stack up. In this embodiment, the suspension member 106 and biphasic material layer 118 having solid layer 602 and liquid layer 604 that can be formed as discussed in reference to FIG. 6. In this stack up, however, the biphasic material layer 118 is formed on a substrate layer 802, which is then attached (e.g., chemically bonded or otherwise adhered) to the surface of the suspension member 106. For example, the substrate layer 802 may be a silicone membrane having a compliance similar to, or that does not otherwise interfere with the operation of, the suspension member 106. The stack up may be formed in manner similar to that described in reference to FIG. 6, except that the solid layer 602 and liquid layer 604 are formed on substrate layer 802, and substrate layer 802 is attached to a surface of suspension member 106. The solid layer 602 and the liquid layer 604 may be formed before or after the substrate layer 802 is attached to the suspension member 106. For example, in one embodiment, the suspension member 106 is formed as previously discussed, then the substrate layer 802 is attached to the surface of the suspension member 106, followed by formation of the solid and liquid layers 602, 604. In another embodiment, the biphasic material layer 118 is a preformed stack up including the substrate layer 802, solid layer 602 and liquid layer 604, which are then attached to the suspension member 106 as a single unit.

Figure 9:
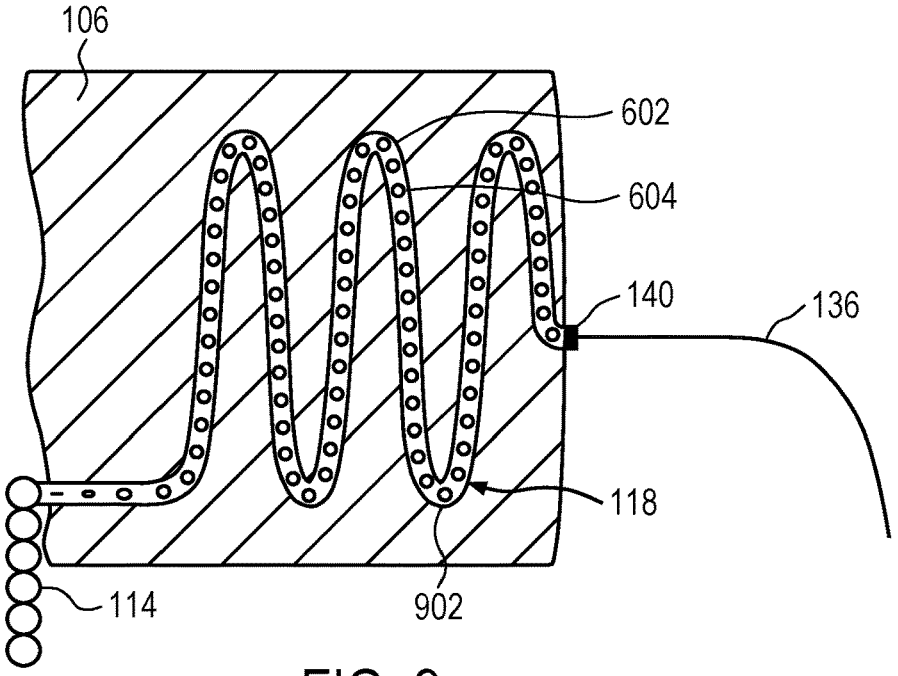
FIG. 9 illustrates a top plan view of an electrically conductive biphasic material layer patterned on a suspension member.

FIG. 9 illustrates a top plan view of a biphasic material layer that is patterned on the suspension member. Representatively, in this embodiment, the biphasic material layer 118, including solid and liquid layers 602, 604, respectively, is formed on the surface of the suspension member 106 and patterned into a conductive trace 902. The conductive trace 902 is patterned (e.g., lithography, photolithography or the like) to electrically connect voice coil 114 with wire 136. The conductive trace 902 includes each of the solid and liquid layers 602, 604, respectively, of the biphasic material layer 118 to allow for transmission of an electric current. For example, in one embodiment, conductive trace 902 may be in a sinusoidal like pattern with one end terminating at the voice coil and another end terminating at the edge of suspension member 106 near wire 136. In other embodiments, the conductive trace 902 may have a grate or lattice type pattern.

Figure 10:
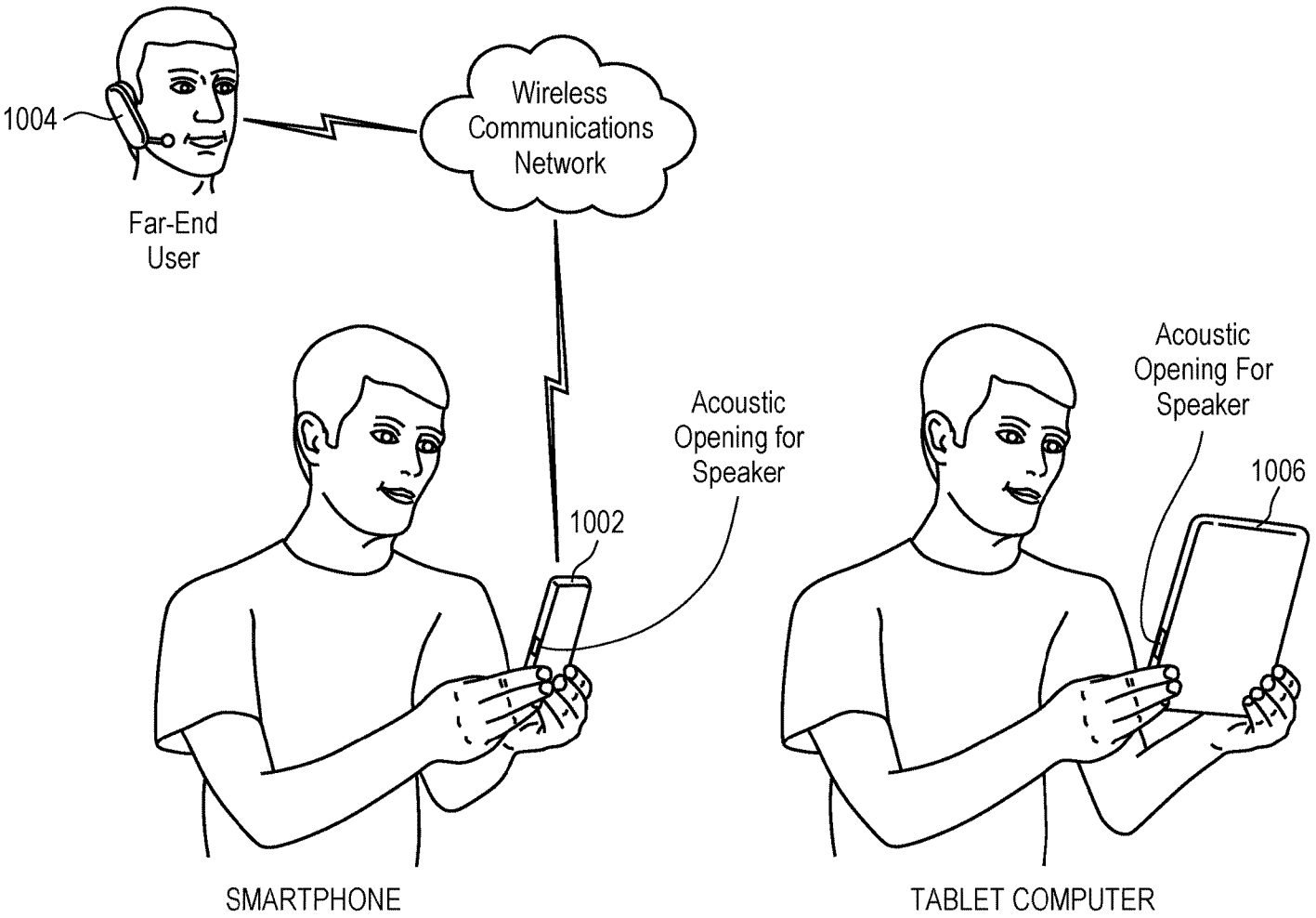
FIG. 10 illustrates one embodiment of a simplified schematic view of one embodiment of an electronic device in which a transducer may be implemented.

FIG. 10 illustrates one embodiment of a simplified schematic view of one embodiment of an electronic device in which a transducer, such as that described herein, may be implemented. As seen in FIG. 10, the transducer may be integrated within a consumer electronic device 1002 such as a smart phone with which a user can conduct a call with a far-end user of a communications device 1004 over a wireless communications network; in another example, the transducer may be integrated within the housing of a tablet computer 1006. These are just two examples of where the transducer described herein may be used, it is contemplated, however, that the transducer may be used with any type of electronic device in which a transducer, for example, a loudspeaker, receiver, actuator, or vibration motor, is desired, for example, a tablet computer, a desk top computing device or other display device.

Figure 11:
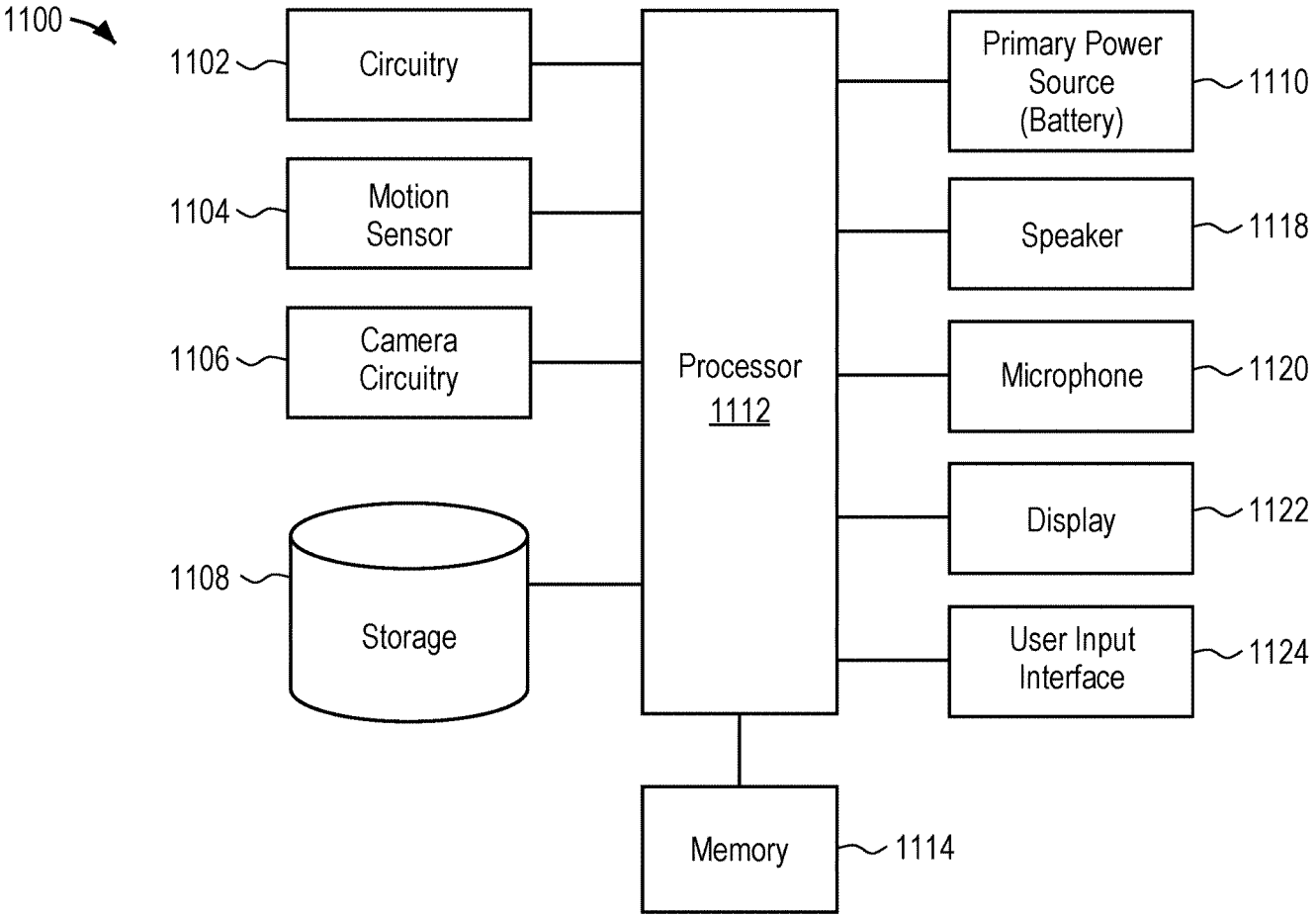
FIG. 11 illustrates a block diagram of some of the constituent components of an embodiment of an electronic device in which an embodiment of the invention may be implemented.

FIG. 11 illustrates a block diagram of some of the constituent components of an embodiment of an electronic device in which an embodiment of the invention may be implemented. Device 1100 may be any one of several different types of consumer electronic devices. For example, the device 1100 may be any transducer-equipped mobile device, such as a cellular phone, a smart phone, a media player, or a tablet-like portable computer.

In this aspect, electronic device 1100 includes a processor 1112 that interacts with camera circuitry 1106, motion sensor 1104, storage 1108, memory 1114, display 1122, and user input interface 1124. Main processor 1112 may also interact with circuitry 1102, primary power source 1110, speaker 1118, and microphone 1120. Speaker 1118 may be a speaker such as that described in reference to FIG. 1. The various components of the electronic device 1100 may be digitally interconnected and used or managed by a software stack being executed by the processor 1112. Many of the components shown or described here may be implemented as one or more dedicated hardware units and/or a programmed processor (software being executed by a processor, e.g., the processor 1112).

The processor 1112 controls the overall operation of the device 1100 by performing some or all of the operations of one or more applications or operating system programs implemented on the device 1100, by executing instructions for it (software code and data) that may be found in the storage 1108. The processor 1112 may, for example, drive the display 1122 and receive user inputs through the user input interface 1124 (which may be integrated with the display 1122 as part of a single, touch sensitive display panel). In addition, processor 1112 may send an audio signal to speaker 1118 to facilitate operation of speaker 1118.

Storage 1108 provides a relatively large amount of "permanent" data storage, using nonvolatile solid state memory (e.g., flash storage) and/or a kinetic nonvolatile storage device (e.g., rotating magnetic disk drive). Storage 1108 may include both local storage and storage space on a remote server. Storage 1108 may store data as well as software components that control and manage, at a higher level, the different functions of the device 1100.

In addition to storage 1108, there may be memory 1114, also referred to as main memory or program memory, which provides relatively fast access to stored code and data that is being executed by the processor 1112. Memory 1114 may include solid state random access memory (RAM), e.g., static RAM or dynamic RAM. There may be one or more processors, e.g., processor 1112, that run or execute various software programs, modules, or sets of instructions (e.g., applications) that, while stored permanently in the storage 1108, have been transferred to the memory 1114 for execution, to perform the various functions described above.

The device 1100 may include circuitry 1102. In one embodiment, circuitry 1102 may include communications circuitry having components used for wired or wireless communications, such as two-way conversations and data transfers. For example, circuitry 1102 may include RF communications circuitry that is coupled to an antenna, so that the user of the device 1100 can place or receive a call through a wireless communications network. The RF communications circuitry may include a RF transceiver and a cellular baseband processor to enable the call through a cellular network. For example, circuitry 1102 may include Wi-Fi communications circuitry so that the user of the device 1100 may place or initiate a call using voice over Internet Protocol (VOIP) connection, transfer data through a wireless local area network. In addition, circuitry 1102 may includer speaker circuitry and/or diaphragm displacement sensing circuitry associated with transducer 100 as previous discussed.

The device may include a microphone 1120. Microphone 1120 may be an acoustic-to-electric transducer or sensor that converts sound in air into an electrical signal. The microphone circuitry may be electrically connected to processor 1112 and power source 1110 to facilitate the microphone operation (e.g. tilting).

The device 1100 may include a motion sensor 1104, also referred to as an inertial sensor, that may be used to detect movement of the device 1100. The motion sensor 1104 may include a position, orientation, or movement (POM) sensor, such as an accelerometer, a gyroscope, a light sensor, an infrared (IR) sensor, a proximity sensor, a capacitive proximity sensor, an acoustic sensor, a sonic or sonar sensor, a radar sensor, an image sensor, a video sensor, a global positioning (GPS) detector, an RF or acoustic doppler detector, a compass, a magnetometer, or other like sensor. For example, the motion sensor 1104 may be a light sensor that detects movement or absence of movement of the device 1100, by detecting the intensity of ambient light or a sudden change in the intensity of ambient light. The motion sensor 1104 generates a signal based on at least one of a position, orientation, and movement of the device 1100. The signal may include the character of the motion, such as acceleration, velocity, direction, directional change, duration, amplitude, frequency, or any other characterization of movement. The processor 1112 receives the sensor signal and controls one or more operations of the device 1100 based in part on the sensor signal.

The device 1100 also includes camera circuitry 1106 that implements the digital camera functionality of the device 1100. One or more solid state image sensors are built into the device 1100, and each may be located at a focal plane of an optical system that includes a respective lens. An optical image of a scene within the camera's field of view is formed on the image sensor, and the sensor responds by capturing the scene in the form of a digital image or picture consisting of pixels that may then be stored in storage 1108. The camera circuitry 1106 may also be used to capture video images of a scene.

Device 1100 also includes primary power source 1110, such as a built in battery, as a primary power supply.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, the transducer described herein could be acoustic-to-electric transducers or sensor that converts sound in air into an electrical signal, such as for example, a microphone, a vibration motor, or other type of device that could benefit from a compliant or stretchable biphasic electrode. The description is thus to be regarded as illustrative instead of limiting.

What is claimed is:

1. A micro speaker comprising:

a frame having a terminal coupled thereto;

a magnet assembly coupled to the frame, the magnet assembly forming an air gap through which a magnetic flux is directed;

a voice coil suspended in the air gap;

a diaphragm coupled to the voice coil; and a compliant suspension member for suspending the voice coil and the diaphragm from the frame, the compliant suspension member having a surface that occupies an entire space between the diaphragm and the frame, the voice coil is attached to the surface and an electrically conductive biphasic member is attached to a portion of the surface extending along only one side of the voice coil, and the electrically conductive biphasic member electrically connects the voice coil to the terminal.

2. The micro speaker of claim 1 wherein the electrically conductive biphasic member comprises a solid component formed on the suspension member and a liquid component formed on the solid component.

3. The micro speaker of claim 2 wherein the solid component comprises a gold-gallium alloy.

4. The micro speaker of claim 2 wherein the liquid component comprises liquid gallium deposits.

5. The micro speaker of claim 1 wherein the suspension member is a solid membrane, and the electrically conductive biphasic member comprises a film of biphasic material, and the film of biphasic material is formed on the surface of the suspension member.

6. The micro speaker of claim 1 wherein the electrically conductive biphasic member comprises a layer of gold-gallium alloy formed on the suspension member and a plurality of liquid gallium protrusions formed on the layer of gold-gallium alloy.

7. The micro speaker of claim 1 further comprising a circuit electrically connected to the terminal, and wherein the circuit is a diaphragm displacement sensing circuit operable to detect a displacement of the diaphragm by detecting an electrical resistance resulting from a strain on the electrically conductive biphasic member as the diaphragm is displaced.

8. An electromechanical transducer comprising:

a stationary portion having a terminal coupled thereto;

a moving portion that is operable to move in response to a Lorentz force and generate a physical vibration or sound;

a compliant suspension member for suspending the moving portion from the stationary portion, the moving portion is positioned on a surface of the compliant suspension member; and a first biphasic electrode layer and a second biphasic electrode layer coupled to the compliant suspension member, the first and second biphasic electrode layers are operable to provide an electrical connection between the moving portion and the terminal coupled to the stationary portion, wherein the first biphasic electrode layer comprises a side coupled to one side of the moving portion and having a length less than a length of the one side of the moving portion and the second biphasic electrode layer comprises a side coupled to another side of the moving portion and having a length less than a length of the another side of the moving portion.

9. The transducer of claim 8 wherein the entire first biphasic electrode layer and the entire second biphasic electrode layer are spaced a distance from one another that is at least equal to a distance between the one side and the another side of the moving portion such that the first biphasic electrode layer is electrically isolated from the second biphasic electrode layer.

10. The transducer of claim 8 wherein the stationary portion comprises a frame and the moving portion comprises a voice coil coupled to a diaphragm.

11. The transducer of claim 8 wherein the compliant suspension member is a solid membrane that extends around an entire perimeter of the moving portion, and the first and second biphasic electrode layers extend around less than an entire perimeter of the compliant suspension member.

12. The transducer of claim 8 wherein the first biphasic electrode layer or the second biphasic electrode layer comprises a solid layer of a conductive alloy deposited on a surface of the compliant suspension member and a liquid layer comprising conductive projections formed on the solid layer.

13. The transducer of claim 8 further comprising a circuit electrically connected to the terminal, and wherein the circuit is operable to detect a strain on the first biphasic electrode layer or the second biphasic electrode layer and determine a displacement of the moving portion.

14. The transducer of claim 8 further comprising a circuit electrically connected to the terminal, and wherein the first biphasic electrode layer or the second biphasic electrode layer is operable to modify an excursion of the moving portion depending upon a strain on the first biphasic electrode layer or the second biphasic electrode layer.

15. The transducer of claim 8 wherein the transducer is a speaker.

16. A micro speaker suspension member, the micro speaker suspension member comprising:

a compliant membrane dimensioned to suspend a planar micro speaker diaphragm and voice coil from a micro speaker frame, the compliant membrane comprises a sheet of compliant material positioned across an opening in the micro speaker frame, the planar micro speaker diaphragm is attached to a first surface of the sheet of compliant material and the voice coil is attached to a second surface of the sheet of compliant material; and a biphasic electrode coupled to the compliant membrane, the biphasic electrode having a solid layer coupled to the second surface of the sheet of compliant material and a liquid layer coupled to the solid layer, the solid layer occupies an entire space between at least one side of the planar micro speaker diaphragm and the frame.

17. The micro speaker suspension member of claim 16 wherein the solid layer comprises a gold-gallium alloy film formed directly on the compliant membrane.

18. The micro speaker suspension member of claim 16 wherein the liquid layer comprises a plurality of discrete liquid gallium deposits formed directly on the solid layer.

19. The micro speaker suspension member of claim 16 wherein the biphasic electrode comprises at least one conductive trace line patterned to electrically connect the voice coil to a circuit.

20. The micro speaker suspension member of claim 16 wherein the biphasic electrode is a first biphasic electrode, and the speaker suspension member further comprises a second biphasic electrode coupled to the sheet of compliant material, and wherein the first biphasic electrode is spaced a distance from the second biphasic electrode.

21. A micro speaker comprising:

a frame having a terminal coupled thereto;

a magnet assembly coupled to the frame, the magnet assembly forming an air gap through which a magnetic flux is directed;

a voice coil suspended in the air gap;

a diaphragm coupled to the voice coil; and a compliant suspension member for suspending the voice coil and the diaphragm from the frame, the compliant suspension member having a planar region surrounded by a bowed region, an entire bottom side of the diaphragm is attached to a top surface of the planar region, an electrically conductive biphasic member is attached to, and conforms to, the bowed region, and the voice coil is attached to a same surface of the compliant suspension member as the electrically conductive biphasic member, and the electrically conductive biphasic member electrically connects the voice coil to the terminal.

22. The micro speaker of claim 21 wherein the electrically conductive biphasic member comprises a first solid layer formed on the compliant suspension member, a liquid layer formed on the first solid layer and a second solid layer formed on the liquid layer.

23. The micro speaker of claim 21 wherein the diaphragm is attached to a top side of the compliant suspension member and the electrically conductive biphasic member is attached to a bottom side of the compliant suspension member.

24. The micro speaker of claim 21 wherein the electrically conductive biphasic member comprises a first section spaced a distance from a second section, and the compliant suspension member occupies the entire space between the first section and the second section.

25. The micro speaker of claim 24 wherein the terminal comprises a positive voice coil terminal and a negative voice coil terminal, and the first section electrically connects an inner voice coil layer to the positive voice coil terminal, and the second section electrically connects an outer voice coil layer to the negative voice coil terminal.

* * * * *